US010863766B2

(12) United States Patent
Sutton et al.

(10) Patent No.: US 10,863,766 B2
(45) Date of Patent: Dec. 15, 2020

(54) APPARATUS FOR HEATING SMOKABLE MATERIAL, ARTICLE FOR USE THEREWITH AND METHOD OF MANUFACTURE OF ARTICLE

(71) Applicant: BRITISH AMERICAN TOBACCO (INVESTMENTS) LIMITED, London (GB)

(72) Inventors: Joseph Sutton, London (GB); Dominic Woodcock, London (GB); Hitesh Vallabh, London (GB); Neil Litten, London (GB); Harpal Singh, London (GB); Darren Seymour, London (GB); David Russell, London (GB); Ahmad Bitar, London (GB)

( * ) Notice: Subject to any disclaimer, the term of this patent is extended or adjusted under 35 U.S.C. 154(b) by 375 days.

(21) Appl. No.: 15/563,065

(22) PCT Filed: Mar. 31, 2016

(86) PCT No.: PCT/EP2016/057097

§ 371 (c)(1),
(2) Date: Sep. 29, 2017

(87) PCT Pub. No.: WO2016/156510

PCT Pub. Date: Oct. 6, 2016

(65) Prior Publication Data

US 2018/0338520 A1 Nov. 29, 2018

(30) Foreign Application Priority Data

Mar. 31, 2015 (GB) ..... 1505593.2

(51) Int. Cl.
*A24F 47/00* (2020.01)
*A24B 3/14* (2006.01)
(Continued)

(52) U.S. Cl.
CPC ..... *A24B 3/14* (2013.01); *A24B 15/14* (2013.01); *A24D 1/20* (2020.01); *A24F 47/004* (2013.01); *A24F 47/008* (2013.01)

(58) Field of Classification Search
CPC ..... A24D 1/20
See application file for complete search history.

(56) References Cited

U.S. PATENT DOCUMENTS 2,057,353 A 10/1936 Whittemore
2,937,648 A 5/1960 Meyer
(Continued)

FOREIGN PATENT DOCUMENTS

CN 1925757 3/2007
CN 201054977 5/2008
(Continued)

OTHER PUBLICATIONS

Japanese Office Action, Japanese Application No. 2015-522065, dated Jan. 5, 2016, 2 pages.
(Continued)

*Primary Examiner* — Eric Yaary
(74) *Attorney, Agent, or Firm* — Patterson Thuente Pedersen, P.A.

(57) ABSTRACT

An article is provided for use with an apparatus for heating smokable material. The article has a body of porous aerosol containment material. An annular first body of smokable material is located around the body of porous aerosol containment material. There is also provided apparatus for heating smokable material having a first heater extending along an axis and a second heater spaced from and at least partially surrounding the first heater. A method of manufacturing an article for use with an apparatus is also disclosed in which an assembly having porous aerosol containment material on a first layer of smokable material is provided and
(Continued)

rolled so the first layer of smokable material becomes an annular body of smokable material located around the porous aerosol containment material.

16 Claims, 4 Drawing Sheets

(51) Int. Cl.
*A24D 1/20* (2020.01)
*A24B 15/14* (2006.01)

(56) References Cited

U.S. PATENT DOCUMENTS

| | | | | |
|---|---|---|---|---|
| 2,991,788 | A | 7/1961 | Brost | |
| 3,148,996 | A | 9/1964 | Vukasovich | |
| 3,844,199 | A | 10/1974 | Block et al. | |
| 4,219,031 | A * | 8/1980 | Rainer | A24B 15/165 131/340 |
| 4,827,950 | A | 5/1989 | Banerjee | |
| 4,846,199 | A | 7/1989 | Rose | |
| 4,924,886 | A * | 5/1990 | Litzinger | A24B 15/10 131/194 |
| 5,065,776 | A * | 11/1991 | Lawson | A24B 15/165 131/365 |
| 5,115,823 | A * | 5/1992 | Keritsis | A24D 3/06 131/335 |
| 5,129,409 | A * | 7/1992 | White | A24B 15/165 131/360 |
| 5,144,962 | A | 9/1992 | Counts | |
| 5,369,723 | A | 11/1994 | Counts | |
| 5,415,186 | A | 5/1995 | Casey, III et al. | |
| 5,611,360 | A * | 3/1997 | Tang | A24F 47/004 131/194 |
| 5,692,526 | A | 12/1997 | Adams et al. | |
| 5,954,060 | A * | 9/1999 | Cardarelli | A24D 3/04 131/336 |
| 6,280,793 | B1 | 8/2001 | Atwell | |
| 6,532,965 | B1 | 3/2003 | Abhulimen | |
| 8,975,764 | B1 | 3/2015 | Abehasera | |
| 9,623,205 | B2 | 4/2017 | Buchberger | |
| 9,974,335 | B2 | 5/2018 | Lord | |
| 10,111,466 | B2 | 10/2018 | Lord | |
| 2003/0063902 | A1 | 4/2003 | Pedtrotti | |
| 2004/0065749 | A1 | 4/2004 | Kotary | |
| 2006/0131439 | A1 | 6/2006 | Lakatos | |
| 2007/0137667 | A1* | 6/2007 | Zhuang | A24D 1/00 131/360 |
| 2009/0288668 | A1 | 11/2009 | Inagaki | |
| 2009/0293888 | A1 | 12/2009 | Williams et al. | |
| 2009/0302019 | A1 | 12/2009 | Selenski | |
| 2010/0006113 | A1 | 1/2010 | Urtsev | |
| 2011/0005535 | A1 | 1/2011 | Xiu | |
| 2011/0094523 | A1 | 4/2011 | Thorens | |
| 2011/0126848 | A1 | 6/2011 | Zuber | |
| 2011/0155153 | A1 | 6/2011 | Thorens | |
| 2011/0209717 | A1 | 9/2011 | Han | |
| 2011/0303231 | A1 | 12/2011 | Li | |
| 2012/0111347 | A1 | 5/2012 | Hon | |
| 2012/0227753 | A1 | 9/2012 | Newton | |
| 2012/0234821 | A1 | 9/2012 | Shimizu | |
| 2012/0255567 | A1 | 10/2012 | Rose et al. | |
| 2012/0279512 | A1 | 11/2012 | Hon | |
| 2012/0285475 | A1 | 11/2012 | Liu | |
| 2013/0037041 | A1 | 2/2013 | Worm et al. | |
| 2013/0056013 | A1 | 3/2013 | Terry | |
| 2013/0192615 | A1 | 8/2013 | Tucker | |
| 2013/0192623 | A1 | 8/2013 | Tucker | |
| 2013/0298905 | A1 | 11/2013 | Levin | |
| 2013/0306085 | A1* | 11/2013 | Sanchez | A24D 3/04 131/344 |
| 2014/0069444 | A1 | 3/2014 | Cyphert et al. | |
| 2014/0202454 | A1 | 7/2014 | Buchberger | |
| 2014/0299142 | A1* | 10/2014 | Dincer | A24D 3/041 131/329 |
| 2015/0020831 | A1 | 1/2015 | Weigensberg et al. | |
| 2015/0150302 | A1* | 6/2015 | Metrangolo | A24B 3/14 131/77 |
| 2015/0157055 | A1 | 6/2015 | Lord | |
| 2015/0196058 | A1 | 7/2015 | Lord | |
| 2015/0245654 | A1 | 9/2015 | Memari et al. | |
| 2015/0258288 | A1 | 9/2015 | Sullivan | |
| 2015/0333552 | A1 | 11/2015 | Alarcon | |
| 2015/0333561 | A1 | 11/2015 | Alarcon | |
| 2016/0106154 | A1 | 4/2016 | Lord | |
| 2016/0250201 | A1 | 9/2016 | Rose et al. | |
| 2016/0278436 | A1 | 9/2016 | Verleur et al. | |
| 2016/0353804 | A1 | 12/2016 | Lord | |
| 2017/0114965 | A1 | 4/2017 | Maglica et al. | |
| 2017/0173278 | A1 | 6/2017 | Buchberger | |
| 2017/0208865 | A1 | 7/2017 | Nettenstrom et al. | |
| 2017/0251725 | A1 | 9/2017 | Buchberger et al. | |
| 2018/0192705 | A1 | 7/2018 | Lord | |
| 2018/0199618 | A1 | 7/2018 | Fuisz et al. | |
| 2018/0235284 | A1 | 8/2018 | Lord | |

FOREIGN PATENT DOCUMENTS

| | | | |
|---|---|---|---|
| CN | 201079011 | | 7/2008 |
| CN | 101277623 | | 10/2008 |
| CN | 101500443 | | 8/2009 |
| CN | 201379072 | | 1/2010 |
| CN | 101843368 | | 9/2010 |
| CN | 103929988 | | 7/2014 |
| CN | 103974369 | | 8/2014 |
| CN | 104095293 | | 10/2014 |
| CN | 203943069 | | 11/2014 |
| CN | 204120237 | | 1/2015 |
| CN | 104349687 | | 2/2015 |
| DE | 822964 | | 11/1951 |
| DE | 29713866 | | 11/1997 |
| DE | 102006004484 | | 8/2007 |
| DE | 102007011120 | | 9/2008 |
| EP | 0532194 | | 3/1993 |
| EP | 0712584 | | 5/1996 |
| EP | 0845220 | | 6/1998 |
| EP | 1283062 | | 2/2003 |
| EP | 1736065 | A1 | 12/2006 |
| EP | 2022349 | | 2/2009 |
| EP | 2113178 | | 11/2009 |
| EP | 2119375 | A1 | 11/2009 |
| EP | 2394520 | | 12/2011 |
| EP | 2404515 | | 1/2012 |
| EP | 2444112 | | 4/2012 |
| EP | 2939553 | | 11/2015 |
| GB | 2496105 | | 5/2013 |
| JP | S51-030900 | U | 3/1976 |
| JP | 3153675 | U | 9/1976 |
| JP | H7502188 | | 3/1995 |
| JP | H11-507234 | | 6/1999 |
| JP | 3392138 | | 3/2003 |
| JP | 2007267749 | | 10/2007 |
| JP | 2009502136 | | 1/2009 |
| JP | 2009-537119 | | 10/2009 |
| JP | 2010520742 | | 6/2010 |
| JP | 201476065 | | 5/2014 |
| JP | 2014525237 | | 9/2014 |
| KR | 20-2011-0006928 | | 7/2011 |
| KR | 101081481 | | 11/2011 |
| RU | 103281 | | 10/2011 |
| RU | 115629 | | 10/2012 |
| TW | 201225862 | | 7/2012 |
| WO | WO9406313 | | 3/1994 |
| WO | WO9632854 | | 10/1996 |
| WO | WO9836651 | | 8/1998 |
| WO | WO2006048774 | | 5/2006 |
| WO | WO2007012007 | | 1/2007 |
| WO | WO 2007078273 | | 7/2007 |
| WO | WO2008015441 | | 2/2008 |
| WO | WO2008029381 | | 3/2008 |
| WO | WO2009022232 | | 2/2009 |
| WO | WO 2010/045671 | A1 | 4/2010 |

(56) References Cited

FOREIGN PATENT DOCUMENTS

| | | | |
|---|---|---|---|
| WO | WO 2011/107737 | A1 | 9/2011 |
| WO | WO 2011/124033 | | 10/2011 |
| WO | WO 2011146372 | | 11/2011 |
| WO | WO 2011/160788 | | 12/2011 |
| WO | WO 2012/072762 | | 6/2012 |
| WO | WO2012/156700 | | 11/2012 |
| WO | WO2013/076098 | | 5/2013 |
| WO | WO 2013/083631 | A1 | 6/2013 |
| WO | WO2013/098395 | | 7/2013 |
| WO | WO2013098395 | | 7/2013 |
| WO | WO 2013/116571 | A1 | 8/2013 |
| WO | WO2013148810 | | 10/2013 |
| WO | WO2013178766 | | 12/2013 |
| WO | WO2014061477 | | 4/2014 |
| WO | WO2014/106093 | | 7/2014 |
| WO | WO2014104078 | | 7/2014 |
| WO | WO2014136872 | | 9/2014 |

OTHER PUBLICATIONS

Canadian Office Action, Application No. 2,878,973, dated Jan. 22, 2016, 6 pages.
Application and File History for U.S. Appl. No. 14/415,540, filed Jan. 16, 2015, inventor Lord.
International Search Report and Written Opinion dated Dec. 2, 2013, for Application No. PCT/EP2013/064950 filed Jul. 15, 2013.
IPRP dated Oct. 31, 2014, for Application No. PCT/EP2013/064950 filed Jul. 15, 2013.
Canadian Office Action, Application No. 2,878,959, dated Jan. 18, 2016, 6 pages.
Japanese Office Action, Application No. 2015-522064, dated Dec. 28, 2015, 2 pages.
Korean Office Action, Application No. 10-2015-7001256, dated Sep. 7, 2016, 11 pages.
Korean Office Action, Application No. 10-2015-7001257, dated Sep. 8, 2016, 15 pages.
Chinese Office Action, Chinese Application No. 201380038055.5, dated Apr. 18, 2016, 9 pages.
Japanese Office Action for Japanese Application No. 2015-522066 dated Jan. 5, 2016, 3 pages.
Russian Decision to Grant for Russian Application No. 201500878 dated Sep. 9, 2016.
European Search Report for European Application No. 16189742 dated Mar. 17, 2017.
Chinese Office Action for Chinese Application No. 201380038055.5 dated Jul. 11, 2017, 3 pgs.
European Notice of Opposition for European Patent No. EP2871984 dated Jun. 5, 2017, 17 pgs.
Russian Decision to Grant from Russian Application No. 2015100881 dated Apr. 6, 2016.
International Search Report and Written Opinion, Application No. PCT/EP2013/064952, dated Oct. 11, 2013.
International Preliminary Report on Patentability, dated Oct. 27, 2014, Application No. PCT/EP2013/064952.
Application and File History for U.S. Appl. No. 15/959,687, filed Apr. 23, 2018, Inventor: Christopher Lord.
Application and File History for U.S. Appl. No. 14/415,552, filed Jan. 16, 2015, Inventor: Christopher Lord.
Korean Office Action, Application No. 10-2017-7034160, dated Jul. 18, 2018, 8 pages (16 pages including translation).
European Extended Search Report, Application No. 18195423.1, dated Jan. 29, 2019, 11 pages.
Application and File History for U.S. Appl. No. 15/563,065, filed Sep. 29, 2017, Inventor: Sutton.
Application and File History for U.S. Appl. No. 15/563,078, filed Sep. 29, 2017, Inventor: Sutton.
Application and File History for U.S. Appl. No. 15/563,086, filed Sep. 29, 2017, Inventor: Sutton.
Chinese Office Action and Search Report, Chinese Application No. 201680020842.0, dated Jun. 21, 2019, 25 pages.
Japanese Office Action, Japanese Application No. 2017-551205, dated Sep. 30, 2018, 11 pages including translation.
Japanese Office Action, Japanese Application No. 2017-551206, dated Oct. 23, 2019, 8 pages.
International Search Report and Written Opinion, PCT Application No. PCT/EP2016/057064, dated Oct. 19, 2016, 14 pages.
Search Report, GB Application No. GB15505597.3, dated Oct. 7, 2015, 3 pages.
Chinese Office Action and Chinese Search Report, Chinese Application No. CN201680020844.X, dated Jun. 24, 2019, 22 pages.
Japanese Office Action, Japanese Application No. 2017551205, dated Sep. 29, 2018, 11 pages including translation.
GB Search Report, Application No. GB1505593.2, dated Sep. 22, 2015, 6 pages.
Japanese Office Action, Japanese Application No. 2017551218, dated Aug. 6, 2019, 16 pages including translation.
Extended European Search Report, European Application No. 19174777.3, dated Nov. 11, 2019, 7 pages.
Korean Decision for Refusal for Korean Application No. KR2020110006928 dated Jan. 10, 2019.
Chinese Office Action, Chinese Application No. 201680020758.9, dated Jul. 23, 2019 21 pages.
GB Search Report, GB Application No. GB1505595.7, dated Oct. 20, 2015, 4 pages.
Application and File History for U.S. Appl. No. 15/914,139, filed Mar. 7, 2018, Inventor: Lord.
International Search Report, International Application No. PCT/EP2016/057060, dated Sep. 28, 2016, 7 pages.
Korean Notice Trial Decision to Reject for Korean Application No. 10-2015-7001257 dated Aug. 14, 2019, 17 pages.
Russian Office Action, Russian Application No. 2018118998, dated Sep. 24, 2018, 6 pages.
Written Opinion, International Application No. PCT/EP2016/057060, dated Jul. 4, 2017, 6 pages.
Chinese Second Office Action and Search Report, Application No. 201680020844.X, dated May 22, 2020, 23 pages.
European Extended Search Report, Application No. 19174777.3, dated Nov. 11, 2019, 7 pages.
Chinese First Office Action, Application No. 201680020842.2, dated Jun. 21, 2019, 25 pages.
Japanese Office Action, Application No. 2019-124231, dated Oct. 27, 2020, 8 pages.

* cited by examiner

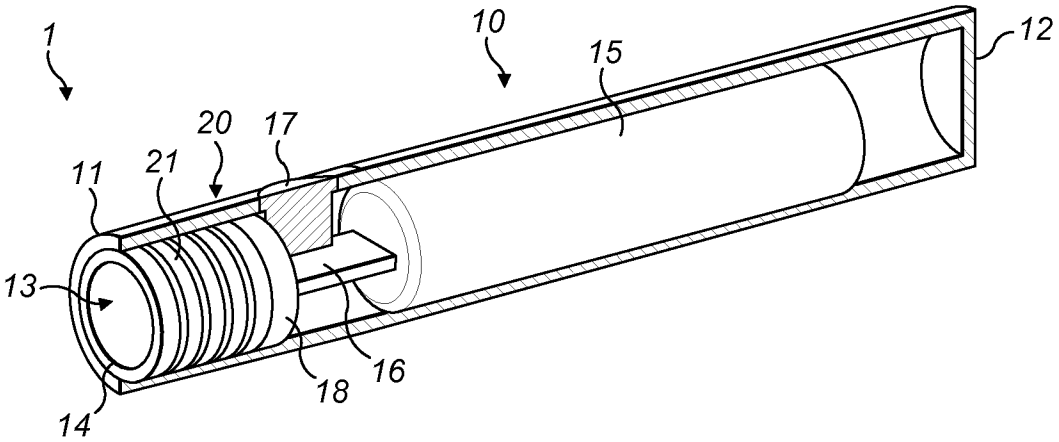
FIG. 5
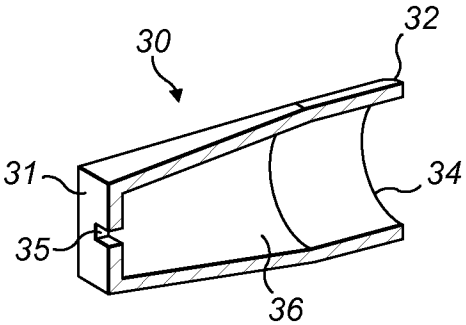

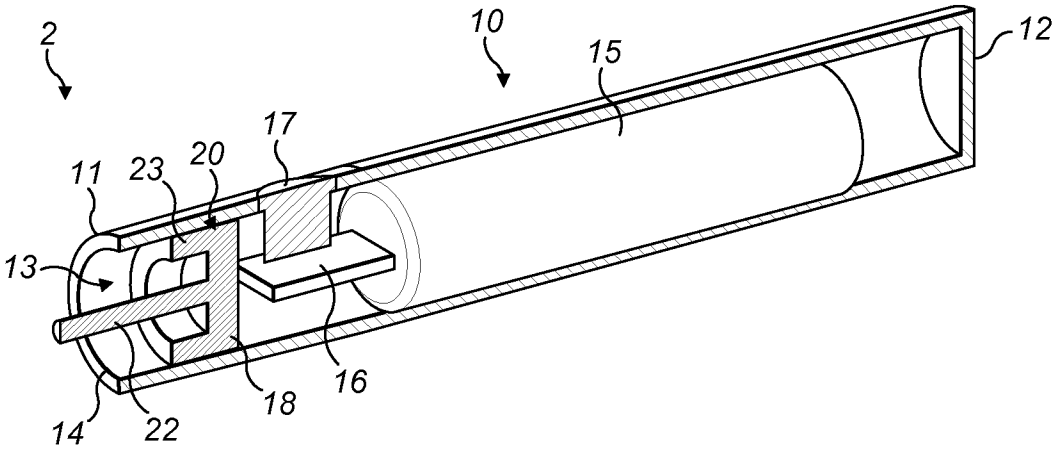
FIG. 6
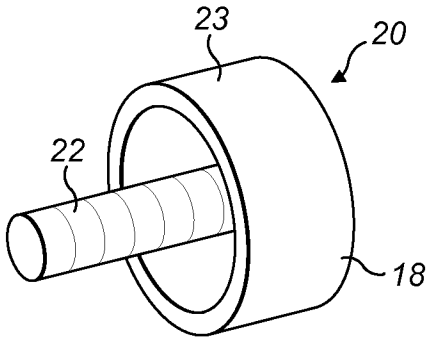
FIG. 7
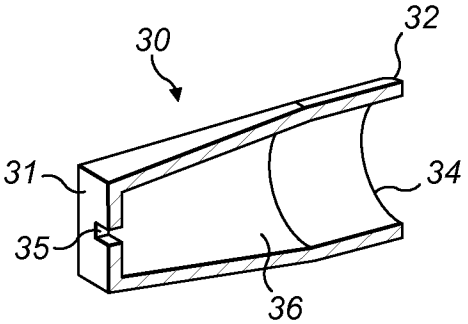

APPARATUS FOR HEATING SMOKABLE MATERIAL, ARTICLE FOR USE THEREWITH AND METHOD OF MANUFACTURE OF ARTICLE

CROSS-REFERENCE TO RELATED APPLICATIONS

The present application is a National Phase entry of PCT Application No. PCT/EP2016/057097, filed Mar. 31, 2016, which claims priority from GB Patent Application No. 1505593.2, filed Mar. 31, 2015, each of which is hereby fully incorporated herein by reference.

TECHNICAL FIELD

The present disclosure relates to an article for use with apparatus for heating smokable material to volatilize at least one component of the smokable material, to a method of manufacturing an article for use with apparatus for heating smokable material, to apparatus for heating smokable material to volatilize at least one component of the smokable material, and to a kit comprising the article and the apparatus.

BACKGROUND

Smoking articles such as cigarettes, cigars and the like burn tobacco during use to create tobacco smoke. Attempts have been made to provide alternatives to these articles by creating products that release compounds without combusting. Examples of such products are so-called "heat not burn" products or tobacco heating devices or products, which release compounds by heating, but not burning, material. The material may be, for example, tobacco or other non-tobacco products, which may or may not contain nicotine.

SUMMARY

According to a first aspect of the present disclosure, there is provided an article for use with apparatus for heating smokable material to volatilize at least one component of the smokable material, the article comprising: a body of porous aerosol containment material; and an annular first body of smokable material located around the body of porous aerosol containment material.

In use, the apparatus with which the article may be used comprises a power source and a heater which is engaged in use by the article.

In an exemplary embodiment, the first body of smokable material is in contact with the body of porous aerosol containment material.

In an exemplary embodiment, the body of porous aerosol containment material is annular.

In an exemplary embodiment, the body of porous aerosol containment material fills a space that is surrounded by the annular first body of smokable material.

In an exemplary embodiment, the body of porous aerosol containment material is located around an air gap of the article.

In an exemplary embodiment, the air gap extends from one side of the article to an opposite side of the article so as to permit the passage of air through the article.

In an exemplary embodiment, a radially-inner surface of the body of porous aerosol containment material defines the air gap.

In an exemplary embodiment, the article comprises a second body of smokable material, the body of porous aerosol containment material is located around the second body of smokable material.

In an exemplary embodiment, the body of porous aerosol containment material is in contact with the second body of smokable material.

In an exemplary embodiment, the second body of smokable material is annular.

In an exemplary embodiment, the article comprises an annular first body of thermally-conductive material, the second body of smokable material is located around the first body of thermally-conductive material.

In an exemplary embodiment, the second body of smokable material is in contact with the first body of thermally-conductive material.

In an exemplary embodiment, a radially-inner surface of the first body of thermally-conductive material defines the air gap.

In an exemplary embodiment, the first body of thermally-conductive material comprises one or more materials selected from the group consisting of: foil, paper, a polymer, a plastics material, and a combination of foil and paper.

In an exemplary embodiment, the smokable material of the first body of smokable material has a form or chemical composition that differs from the form or chemical composition, respectively, of the smokable material of the second body of smokable material.

In an exemplary embodiment, the smokable material of one of the first and second bodies of smokable material has a form so as to be heatable more quickly than the smokable material of the other of the first and second bodies of smokable material. In an exemplary embodiment, the smokable material of one of the first and second bodies of smokable material has a form so as to be heatable more quickly, to volatilize at least one component of the smokable material, than the smokable material of the other of the first and second bodies of smokable material.

In an exemplary embodiment, the smokable material of one of the first and second bodies of smokable material comprises particles of the smokable material having a first mean particle size, and the smokable material of the other of the first and second bodies of smokable material comprises particles of the smokable material having a second mean particle size that is greater than the first mean particle size.

In an exemplary embodiment, the smokable material of one of the first and second bodies of smokable material includes an aerosol forming agent, and the smokable material of the other of the first and second bodies of smokable material is free or substantially free of the aerosol forming agent.

In an exemplary embodiment, the aerosol forming agent comprises glycerol.

In an exemplary embodiment, the article comprises an annular second body of thermally-conductive material located around the first body of smokable material.

In an exemplary embodiment, the second body of thermally-conductive material is in contact with the first body of smokable material.

In an exemplary embodiment, the second body of thermally-conductive material defines an outer surface of the article.

In an exemplary embodiment, the second body of thermally-conductive material comprises one or more materials selected from the group consisting of: foil, paper, a polymer, a plastics material, and a combination of foil and paper.

In an exemplary embodiment, the article has a circular circumference in a plane perpendicular to an axis of the annular first body of smokable material.

In an exemplary embodiment, the smokable material comprises tobacco.

In an exemplary embodiment, the porous aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

According to a second aspect of the present disclosure, there is provided a method of manufacturing an article for use with apparatus for heating smokable material to volatilize at least one component of the smokable material, the method comprising: providing an assembly comprising porous aerosol containment material on a first layer of smokable material; and rolling the assembly so that the first layer of smokable material becomes an annular first body of smokable material located around the porous aerosol containment material.

In an exemplary embodiment, the porous aerosol containment material is arranged to be in contact with the first layer of smokable material.

In an exemplary embodiment, the rolling comprises rolling the assembly so that the porous aerosol containment material becomes an annular body of porous aerosol containment material.

In an exemplary embodiment, the annular body of porous aerosol containment material is arranged to be located around an air gap of the article.

In an exemplary embodiment, a radially-inner surface of the annular body of porous aerosol containment material defines the air gap.

In an exemplary embodiment, the assembly comprises a second layer of smokable material on the porous aerosol containment material.

In an exemplary embodiment, the porous aerosol containment material is arranged to be in contact with the second layer of smokable material.

In an exemplary embodiment, the rolling comprises rolling the assembly so that the second layer of smokable material becomes an annular second body of smokable material.

In an exemplary embodiment, the assembly comprises a first layer of thermally-conductive material on the second layer of smokable material.

In an exemplary embodiment, the second layer of smokable material is arranged to be in contact with the first layer of thermally-conductive material.

In an exemplary embodiment, the rolling comprises rolling the assembly so that the first layer of thermally-conductive material becomes an annular first body of thermally-conductive material.

In an exemplary embodiment, a radially-inner surface of the annular first body of thermally-conductive material defines the air gap.

In an exemplary embodiment, the first layer of thermally-conductive material comprises one or more materials selected from the group consisting of: foil, paper, a polymer, a plastics material, and a combination of foil and paper.

In an exemplary embodiment, the smokable material of the first layer of smokable material has a form or chemical composition that differs from the form or chemical composition, respectively, of the smokable material of the second layer of smokable material.

In an exemplary embodiment, the smokable material of one of the first and second layers of smokable material has a form so as to be heatable more quickly than the smokable material of the other of the first and second layers of smokable material. In an exemplary embodiment, the smokable material of one of the first and second layers of smokable material has a form so as to be heatable more quickly, to volatilize at least one component of the smokable material, than the smokable material of the other of the first and second layers of smokable material.

In an exemplary embodiment, the smokable material of one of the first and second layers of smokable material comprises particles of the smokable material having a first mean particle size, and the smokable material of the other of the first and second layers of smokable material comprises particles of the smokable material having a second mean particle size that is greater than the first mean particle size.

In an exemplary embodiment, the assembly comprises a second layer of thermally-conductive material, and the first layer of smokable material is on the second layer of thermally-conductive material.

In an exemplary embodiment, the second layer of thermally-conductive material is arranged to be in contact with the first layer of smokable material.

In an exemplary embodiment, the rolling comprises rolling the assembly so that the second layer of thermally-conductive material becomes an annular second body of thermally-conductive material.

In an exemplary embodiment, the annular second body of thermally-conductive material defines an outer surface of the article.

In an exemplary embodiment, the second layer of thermally-conductive material comprises one or more materials selected from the group consisting of: foil, paper, a polymer, a plastics material, and a combination of foil and paper.

In an exemplary embodiment, the smokable material comprises tobacco.

In an exemplary embodiment, the porous aerosol containment material comprises one or more materials selected from the group consisting of: wadding, fleece, non-woven material, non-woven fleece, woven material, knitted material, nylon, foam, polystyrene, polyester, polyester filament, polypropylene, and a blend of polyester and polypropylene.

According to a third aspect of the present disclosure, there is provided apparatus for heating smokable material to volatilize at least one component of the smokable material, the apparatus comprising an interface for co-operating with an article containing smokable material, wherein the interface comprises a heating device having: a first heater extending along an axis; and a second heater spaced from and at least partially surrounding the first heater; wherein the first heater has a first length in a direction parallel to the axis, the second heater has a second length in a direction parallel to the axis, and the second length is less than the first length.

In an exemplary embodiment, the first heater has a circular cross-sectional shape in a plane perpendicular to the axis.

In an exemplary embodiment, the second heater has an annular cross-sectional shape in a plane perpendicular to the axis.

In an exemplary embodiment, the second heater is coaxial with the first heater.

In an exemplary embodiment, the first and second lengths are measured from a plane that is perpendicular to the axis.

In an exemplary embodiment, the interface comprises a recess for receiving the cartridge, the apparatus defines an opening into the recess at a first end of the recess, and the first and second heaters extend from a second end of the recess towards the first end of the recess.

In an exemplary embodiment, the first heater projects into the recess, and the second heater surrounds the recess.

In an exemplary embodiment, the apparatus comprises a controller for controlling the supply of electrical power from an electrical power source to the heating device.

In an exemplary embodiment, the controller is for controlling the supply of electrical power from the electrical power source to the first heater independently of the supply of electrical power from the electrical power source to the second heater. In an exemplary embodiment, the controller is for enabling user control of the supply of electrical power from the electrical power source to the first heater independently of the supply of electrical power from the electrical power source to the second heater.

There is also provided a kit comprising an article according to the first aspect of the present disclosure and apparatus for heating the smokable material of the article to volatilize at least one component of the smokable material, wherein the apparatus has an interface and the article is for co-operating with the interface of the apparatus.

In an exemplary embodiment, the apparatus is arranged to heat the smokable material to volatilize the at least one component of the smokable material without combusting the smokable material.

In an exemplary embodiment, the apparatus comprises a heating device for heating the smokable material, and a controller for controlling the supply of electrical power from an electrical power source to the heating device.

In an exemplary embodiment, the apparatus comprises a heating device for heating the smokable material, and a controller arranged to control heating of the heating device so as to cause heating of the smokable material to volatilize the at least one component of the smokable material without combusting the smokable material when the article is co-operating with the interface of the apparatus.

In an exemplary embodiment, the apparatus is according to the third aspect of the present disclosure.

There is also provided an article for use with apparatus for heating smokable material to volatilize at least one component of the smokable material, the article comprising: an annular body of material; an annular first body of smokable material located around the body of material; and an annular second body of smokable material, wherein the body of material is located around the second body of smokable material.

In an exemplary embodiment, the body of material is a body of porous aerosol containment material.

In respective exemplary embodiments, the article according to the fifth aspect of the present disclosure comprises the feature(s) of the above-discussed respective exemplary embodiments of the article according to the first aspect of the present disclosure.

BRIEF DESCRIPTION OF THE DRAWINGS

Embodiments of the disclosure will now be described, by way of example only, with reference to the accompanying drawings, in which:

FIG. 5 shows a partially cut-away perspective view of an example of an apparatus for heating smokable material to volatilize at least one component of the smokable material.

FIG. 6 shows a partially cut-away perspective view of an example of another apparatus for heating smokable material to volatilize at least one component of the smokable material.

FIG. 7 shows a perspective view of a heating device of the apparatus of FIG. 6.

DETAILED DESCRIPTION

As used herein, the term "smokable material" includes materials that provide volatilized components upon heating, typically in the form of an aerosol. "Smokable material" may be a non-tobacco-containing material or a tobacco-containing material. "Smokable material" may, for example, include one or more of tobacco per se, tobacco derivatives, expanded tobacco, reconstituted tobacco, tobacco extract, homogenized tobacco or tobacco substitutes. The smokable material can be in the form of ground tobacco, cut rag tobacco, extruded tobacco, gel or agglomerates. "Smokable material" also may include other, non-tobacco, products, which, depending on the product, may or may not contain nicotine.

As used herein, "polyimide" refers to any polymer comprising or substantially formed of imide monomers and may be saturated or unsaturated. The polyimide may be hydrophobic.

As used herein, the terms "flavor" and "flavorant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may comprise natural or nature-identical aroma chemicals. They may be in any suitable form, for example, oil, liquid, powder, or gel.

As used herein, "annular" means ring-shaped or in the form of a ring. "Annular" does not itself mean circular. In some embodiments, an element that is described herein as "annular" may indeed be circular, but in other embodiments the element may be "annular" and other than circular, such as elliptical or polygonal.

Figure 1:
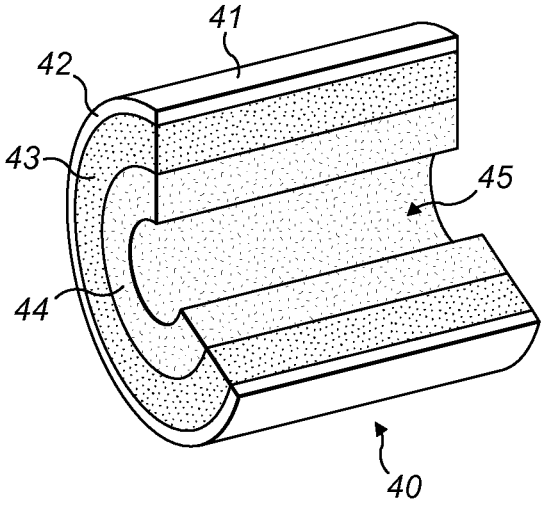
FIG. 1 shows a partially cut-away perspective view of an example of an article for use with apparatus for heating smokable material to volatilize at least one component of the smokable material.
Figure 2:
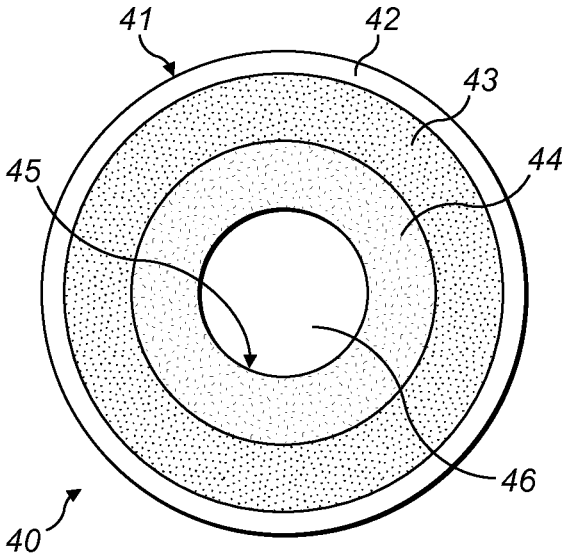
FIG. 2 shows a schematic cross-sectional view of the article of FIG. 1.

Referring to FIGS. 1 and 2, there are shown a partially cut-away perspective view and a schematic cross-sectional view of an example of an article 40 according to an embodiment of the disclosure. The article 40 is adapted for use with apparatus having a power source and a heater which is engaged in use by the article 40. The article 40 of this embodiment is particularly suitable for use with the apparatus 1 shown in FIG. 5, described below.

The article 40 of this embodiment comprises an annular body of smokable material 43 located around a body of porous aerosol containment material 44. Typically, the body of porous aerosol containment material 44 is not formed of a smokable material. In this embodiment, the body of porous aerosol containment material 44 comprises wadding or fleece, with a density of about 100 gsm or about 120 gsm. In some embodiments, the body of porous aerosol containment material 44 is formed of one or more materials that do not contain aerosol-forming materials. In other embodiments, the body of porous aerosol containment material 44 is formed of one or more materials that do contain aerosol-forming materials. The body of porous aerosol containment material 44 may for example be impregnated with smokable material, which may enhance aerosol production.

In this embodiment, the body of smokable material 43 is in contact with the body of porous aerosol containment material 44, but in other embodiments there may be a further layer of material between the body of smokable material 43 and the body of porous aerosol containment material 44. Such a further layer of material may increase the rigidity or robustness of the article 40, may help retain the relative positions of the smokable material 43 and the porous aerosol containment material 44, and/or may help hold different regions of the smokable material 43 together. An example such further layer of material is a layer of reconstituted tobacco paper.

In this embodiment, the body of porous aerosol containment material 44 is annular and is located around an air gap 46 of the article 40. The air gap 46 follows an axis and permits volatilized material to pass out of the article 40 from the body of porous aerosol containment material 44 in use. In this embodiment, the body of porous aerosol containment material 44 defines an inner surface 45 of the article 40, so that a radially-inner surface 45 of the body of porous aerosol containment material 44 defines or delineates the air gap 46. In this embodiment, the air gap 46 is a through hole that extends from one side of the article 40 to an opposite side of the article 40. However, in other embodiments, the air gap 46 may be a blind hole that extends from only one side of the article 40 towards an opposite side of the article 40. In still further embodiments, the air gap 46 may be omitted. In some such further embodiments, the body of porous aerosol containment material 44 fills a space that is surrounded by the annular body of smokable material 43. In some such further embodiments, the body of porous aerosol containment material 44 may be cylindrical rather than annular, and in use volatilized material may pass out of the article 40 from an axial end of the body of porous aerosol containment material 44.

The article 40 of FIGS. 1 and 2 also comprises an annular body of thermally-conductive material 42 located around, and in contact with, the body of smokable material 43. In other embodiments there may be a further layer of material between the body of smokable material 43 and the body of thermally-conductive material 42. In this embodiment, the body of thermally-conductive material 42 comprises a metal foil, such as aluminum foil, but in other embodiments the body of thermally-conductive material 42 may comprise one or more materials selected from the group consisting of: foil, paper, a polymer, a plastics material, and a combination of foil and paper, such as paper overlaid with foil, or the like. An example such paper is reconstituted tobacco paper. The body of thermally-conductive material 42 is for conducting heat from radially-outside of the article 40 to the body of smokable material 43. The body of thermally-conductive material 42 may also increase the rigidity or robustness of the article 40 and/or may provide a substrate for the smokable material 43 so as to help hold different regions of the smokable material 43 together. In this embodiment, the body of thermally-conductive material 42 defines an outer surface 41 of the article 40. In other embodiments, the body of thermally-conductive material 42 may be omitted. In some such other embodiments, the body of smokable material 43 may define the outer surface 41 of the article 40.

In this embodiment, axial ends of each of the body of smokable material 43 and the body of porous aerosol containment material 44 are visible at axial ends of the article 40. However, in other embodiments, one or both of the axial ends of the article 40 may comprise an end member (not shown) covering the axial ends of the body of smokable material 43 and/or of the body of porous aerosol containment material 44. The, or each, end member may be formed by a radially-extending portion of the body of thermally-conductive material 42.

The article 40 of FIGS. 1 and 2 may be manufactured by the following method. First, an assembly comprising porous aerosol containment material, a layer of smokable material, and a layer of thermally-conductive material is provided. In the assembly, the porous aerosol containment material is on, and in contact with, the layer of smokable material. In turn, the layer of smokable material is on, and in contact with, the layer of thermally-conductive material.

Then the assembly is bent or rolled so that: (a) the layer of thermally-conductive material becomes the annular body of thermally-conductive material 42, (b) the layer of smokable material becomes the annular body of smokable material 43, and (c) the porous aerosol containment material becomes the annular body of porous aerosol containment material 44. The assembly may be rolled or bent around a spindle that is placed on the porous aerosol containment material of the assembly and ends up located in the air gap 46 of the article 40. The spindle could be subsequently removed from the air gap 46. Following the rolling or bending, the annular body of thermally-conductive material 42 defines the outer surface 41 of the article 40, and a radially-inner surface of the annular body of porous aerosol containment material 44 defines the air gap 46.

The skilled person would readily understand from the present disclosure how to adapt this method of manufacturing the article 40 of FIGS. 1 and 2 so as to manufacture one of the above-described variations on the article 40. For example, they would understand that they would need to include in the assembly a layer of material between the layer of smokable material and the porous aerosol containment material, and/or between the layer of smokable material and the layer of thermally-conductive material, if they wanted the manufactured article to include the layer of material between the body of smokable material 43 and the body of porous aerosol containment material 44, and/or between the body of smokable material 43 and the body of thermally-conductive material 42, respectively. The skilled person would also be able to adapt the porous aerosol containment material of the assembly to ensure that, in the resultant article, the body of porous aerosol containment material 44 is cylindrical rather than annular. If the article is not to include the annular body of thermally-conductive material 42, then, in the assembly, the layer of smokable material could be on, and in contact with, a substrate layer that is bent or rolled during the bending or rolling procedure and subsequently removed after the bending or rolling so that the body of smokable material 43 defines the outer surface 41 of the article.

Figure 3:
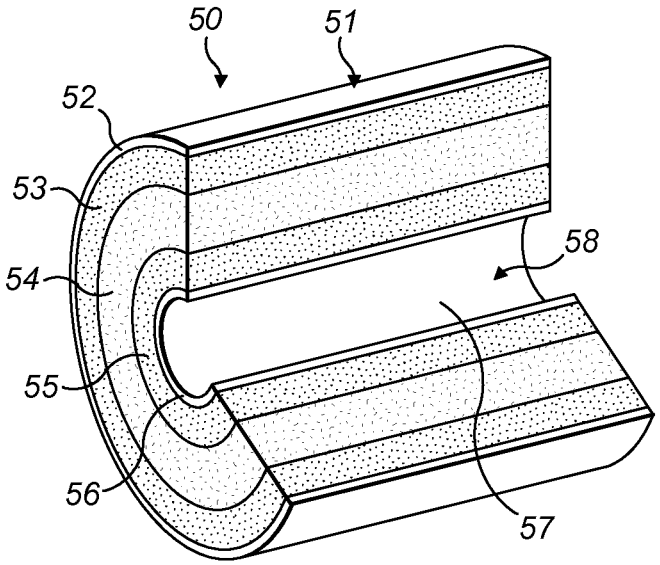
FIG. 3 shows a partially cut-away perspective view of an example of another article for use with apparatus for heating smokable material to volatilize at least one component of the smokable material.
Figure 4:
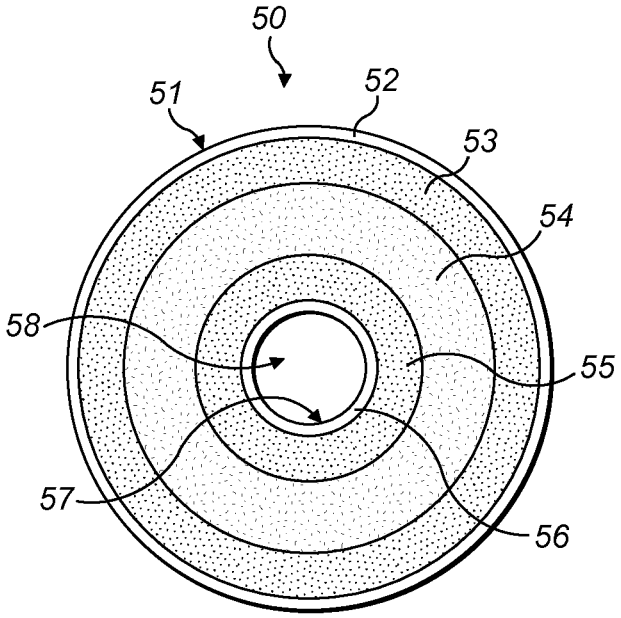
FIG. 4 shows a schematic cross-sectional view of the article of FIG. 3.

Referring to FIGS. 3 and 4, there are shown a partially cut-away perspective view and a schematic cross-sectional view of an example of another article 50 according to an embodiment of the disclosure. The article 50 of this embodiment is particularly suitable for use with the apparatus 2 shown in FIGS. 6 and 7, described below.

The article 50 of this embodiment comprises an annular first body of smokable material 53 located around a body of porous aerosol containment material 54. Typically, the body of porous aerosol containment material 54 is not formed of a smokable material. In this embodiment, the body of porous aerosol containment material 54 comprises wadding or fleece, with a density of about 100 gsm or about 120 gsm. In some embodiments, the body of porous aerosol containment material 54 is formed of one or more materials that do not contain aerosol-forming materials. In other embodiments, the body of porous aerosol containment material 54 is formed of one or more materials that do contain aerosol-forming materials. The body of porous aerosol containment material 54 may for example be impregnated with smokable material, which may enhance aerosol production.

In this embodiment, the first body of smokable material 53 is in contact with the body of porous aerosol containment material 54, but in other embodiments there may be a further layer of material between the first body of smokable material 53 and the body of porous aerosol containment material 54. Such a further layer of material may increase the rigidity or robustness of the article 50, may help retain the relative positions of the smokable material of the first body of smokable material 53 and the body of porous aerosol containment material 54, and/or may help hold different regions of the smokable material of the first body of smokable material 53 together. An example such further layer of material is a layer of reconstituted tobacco paper. In this embodiment, the body of porous aerosol containment material 54 is annular and is located around an air gap 58 of the article 50, although the body of porous aerosol containment material 54 does not itself define or delineate the air gap 58, as will become apparent below.

The article 50 of FIGS. 3 and 4 also comprises an annular first body of thermally-conductive material 52 located around, and in contact with, the first body of smokable material 53. In other embodiments there may be a further layer of material between the first body of smokable material 53 and the first body of thermally-conductive material 52. In this embodiment, the first body of thermally-conductive material 52 comprises a metal foil, such as aluminum foil, but in other embodiments the first body of thermally-conductive material 52 may comprise any of the materials discussed above for the body of thermally-conductive material 52 of the article 40 of FIGS. 1 and 2. The first body of thermally-conductive material 52 is for conducting heat from radially-outside of the article 50 to the first body of smokable material 53. The first body of thermally-conductive material 52 may also increase the rigidity or robustness of the article 50 and/or may provide a substrate for the smokable material of the first body of smokable material 53 so as to help hold different regions of the smokable material together. In this embodiment, the first body of thermally-conductive material 52 defines an outer surface 51 of the article 50. In other embodiments, the first body of thermally-conductive material 52 may be omitted. In some such other embodiments, the first body of smokable material 53 may define the outer surface 51 of the article 50.

The article 50 of FIGS. 3 and 4 also comprises a second body of smokable material 55. The annular body of porous aerosol containment material 54 is located around, and is in contact with, the second body of smokable material 55. In other embodiments, there may be a further layer of material between the second body of smokable material 55 and the body of porous aerosol containment material 54. In various embodiments, such a further layer of material could be made from reconstituted tobacco paper, and/or could provide any of the advantages discussed above for the optional further layer of material between the first body of smokable material 53 and the body of porous aerosol containment material 54.

In the article of FIGS. 3 and 4, the smokable material of the first body of smokable material 53 has a form and chemical composition that is the same as the form and chemical composition, respectively, of the smokable material of the second body of smokable material 55. However, in various other embodiments, the smokable material of the first body of smokable material 53 may have a form or chemical composition that differs from the form or chemical composition, respectively, of the smokable material of the second body of smokable material 55.

For example, in some embodiments, the smokable material of one of the first and second bodies of smokable material 53, 55 has a form so as to be heatable more quickly, for example to volatilize at least one component of the smokable material, than the smokable material of the other of the first and second bodies of smokable material 53, 55. In some embodiments, the smokable material of the first and second bodies of smokable material 53, 55 may have different mean particle sizes. That is, the smokable material of one of the first and second bodies of smokable material 53, 55 may comprise particles of the smokable material having a first mean particle size, and the smokable material of the other of the first and second bodies of smokable material 53, 55 may comprise particles of the smokable material having a second mean particle size that is greater than the first mean particle size. Typically, particles of the smokable material having a smaller mean particle size are heatable more quickly, for example to volatilize at least one component of the smokable material, by a given heat source than are particles of the smokable material having a greater mean particle size. By providing the different bodies of smokable material 53, 55 with different mean particle sizes, progressive heating of the smokable material of the article 50, and thereby progressive generation of aerosol, may be achievable.

In some embodiments, in addition to, or alternatively to, the provision of such different mean particle sizes, the smokable material of the first body of smokable material 53 may have a different chemical composition to the smokable material of the second body of smokable material 55. That is, the ingredient or ingredients of the first body of smokable material 53 may be different to that or those of the second body of smokable material 55. In some such embodiments, the smokable material of one of the first and second bodies of smokable material 53, 55 comprises an aerosol forming agent, such as glycerol, and the smokable material of the other of the first and second bodies of smokable material 53, 55 is free or substantially free of the aerosol forming agent. By providing the different bodies of smokable material 53, 55 with different chemical compositions, progressive heating of the smokable material of the article 50, and thereby progressive generation of aerosol, may be achievable. Alternatively or additionally, heating of one or other of the first and second bodies of smokable material 53, 55 may be provided by the apparatus 1, thus enabling a user to select which of the first and second bodies of smokable material 53, 55 is to be used to create aerosol for their inhalation.

In some embodiments, the difference in chemical composition between the first and second bodies of smokable material 53, 55 may comprise a difference in quantities by weight of a smoke modifying substance, such as a flavorant, in each of the first and second bodies 53, 55, as a percentage of a total weight of the smokable material of the respective first and second bodies 53, 55. For example, in some embodiments, the smokable material of one of the first and second bodies of smokable material 53, 55 may comprise a flavorant, and the smokable material of the other of the first and second bodies of smokable material 53, 55 may be free, or substantially free, of the flavorant. In some embodiments, one of the first and second bodies of smokable material 53, 55 may comprise a first flavorant, and the other of the first and second bodies of smokable material 53, 55 may comprise a second flavorant that is different to the first flavorant. By providing the first and second bodies of smokable material 53, 55 with different quantities of smoke modifying agents or flavorants, in some embodiments a change in flavor of generated aerosol for user inhalation is achievable.

The article 50 of FIGS. 3 and 4 further comprises an annular second body of thermally-conductive material 56. The second body of smokable material 55 is located around, and is in contact with, the second body of thermally-conductive material 56. In other embodiments there may be a further layer of material between the second body of smokable material 55 and the second body of thermally-conductive material 56. In this embodiment, the second body of thermally-conductive material 56 comprises a metal foil, such as aluminum foil, but in other embodiments the second body of thermally-conductive material 56 may comprise any of the materials discussed above for the body of thermally-conductive material 42 of the article 40 of FIGS. 1 and 2.

The second body of thermally-conductive material 56 is for conducting heat from radially-inside of the article 50 to the second body of smokable material 55. The second body of thermally-conductive material 56 may also increase the rigidity or robustness of the article 50 and/or may provide a substrate for the smokable material of the second body of smokable material 55 so as to help hold different regions of the smokable material together. In this embodiment, the second body of thermally-conductive material 56 defines an inner surface 57 of the article 50, so that a radially-inner surface 57 of the second body of thermally-conductive material 56 defines or delineates the air gap 58. The air gap 58 follows an axis and receives the first heater 22 of the apparatus 2 in use. In this embodiment, the air gap 58 is a through hole that extends from one side of the article 50 to an opposite side of the article 50. However, in other embodiments, the air gap 58 may be a blind hole that extends from only one side of the article 50 towards an opposite side of the article 50. In other embodiments, the second body of thermally-conductive material 56 may be omitted. In some such other embodiments, a radially-inner surface of the second body of smokable material 55 may define the inner surface 57 of the article 50 and the air gap 58.

In this embodiment, axial ends of each of the first and second bodies of smokable material 53, 55 and the body of porous aerosol containment material 54 are visible at axial ends of the article 50. However, in other embodiments, one or both of the axial ends of the article 50 may comprise an end member (not shown) covering the axial ends of the first and second bodies of smokable material 53, 55 and/or the body of porous aerosol containment material 54. The, or each, end member may be formed by a radially-extending portion of the first body of thermally-conductive material 52.

The article 50 discussed above is an embodiment of an article comprising an annular body of the alternative material, an annular first body of smokable material located around the body of material, and an annular second body of smokable material, wherein the body of the alternative material is located around the second body of smokable material. In variations to the article 50 discussed above, the porous aerosol containment material may be replaced by an alternative material that is not necessarily porous and/or suitable for aerosol containment. Some such resultant articles may include the first and/or second bodies of thermally-conductive material 52, 56, whereas the first and second bodies of thermally-conductive material 52, 56 may be omitted from other such resultant articles.

The article 50 of FIGS. 3 and 4 may be manufactured by the following method. First, an assembly comprising porous aerosol containment material, first and second layers of smokable material, and first and second layers of thermally-conductive material is provided. In the assembly, the second layer of thermally-conductive material is on, and in contact with, the second layer of smokable material. The second layer of smokable material is on, and in contact with, the porous aerosol containment material. The porous aerosol containment material is on, and in contact with, the first layer of smokable material. The first layer of smokable material is on, and in contact with, the first layer of thermally-conductive material.

Then the assembly is bent or rolled so that: (a) the first layer of thermally-conductive material becomes the annular first body of thermally-conductive material 52, (b) the first layer of smokable material becomes the annular first body of smokable material 53, (c) the porous aerosol containment material becomes the annular body of porous aerosol containment material 54, (d) the second layer of smokable material becomes the annular second body of smokable material 55, and (e) the second layer of thermally-conductive material becomes the annular second body of thermally-conductive material 56. The assembly may be bent or rolled around a spindle that is placed on the second layer of thermally-conductive material of the assembly and ends up located in the air gap 58 of the article 50. The spindle could be subsequently removed from the air gap 58. Following the bending or rolling, the annular first body of thermally-conductive material 52 defines the outer surface 51 of the article 50, and a radially-inner surface of the annular second body of thermally-conductive material 56 defines the air gap 58.

Again, the skilled person would readily understand from the present disclosure how to adapt this method of manufacturing the article 50 of FIGS. 3 and 4 so as to manufacture one of the above-described variations on the article 50. For example, it would be apparent to the skilled person that the first layer of thermally-conductive material may be oversized as compared to the other layers of material in the assembly so that, after the bending or rolling procedure, protruding portions of the first body of thermally-conductive material 52 may be folded to form radially-extending end members of the first body of thermally-conductive material 52, which end members cover the axial ends of the first and second bodies of smokable material 53, 55 and the body of porous aerosol containment material 54.

In each of the above-described embodiments, the article 40, 50 has a circular circumference in a plane perpendicular to an axis of the annular body of smokable material 43, 53. However, in other embodiments, the circumference may be other than circular, such as elliptical or polygonal. In each of the above-described embodiments, various elements of the article 40, 50 are described as being "annular". In the above-described embodiments, each of these elements is annular and circular. However, in other embodiments, one or more of these elements may be annular and other than circular, such as elliptical or polygonal.

In each of the above-described embodiments of the article 40, 50, the smokable material comprises tobacco. However, in other respective embodiments, the smokable material may consist of tobacco, may consist substantially entirely of tobacco, may comprise tobacco and smokable material other than tobacco, may comprise smokable material other than tobacco, or may be free of tobacco. The smokable material may include an aerosol forming agent, such as glycerol.

In each of the above-described embodiments of the article 40, 50, the porous aerosol containment material is a porous material for the containment of aerosol generated in the article 40, 50 by heating the smokable material. In each of the above-described embodiments of the article 40, 50, the porous aerosol containment material comprises wadding or fleece with a density of about 100 gsm or about 120 gsm. In other embodiments, the density of the porous aerosol containment material may be different. However, if the density is too high, the porous aerosol containment material may act as a filter and attenuate generated aerosol. Alternatively, if the density is too low, the porous aerosol containment material may not provide effective aerosol containment. An appropriate density, particularly when the porous aerosol containment material comprises wadding or fleece, may be between about 60 and about 140 gsm, or between about 80 and about 120 gsm. In some embodiments, the aerosol containment material may have a thickness within a range of 1 mm to 2 mm.

In still further embodiments, the porous aerosol containment material may comprise one or more porous materials selected from the group consisting of: wadding, fleece, non-woven material, non-woven fleece, woven material, knitted material, nylon, foam, polystyrene, polyester, polyester filament, polypropylene, and a blend of polyester and polypropylene. When a material other than wadding or fleece is used, the material would have a density chosen to have similar thermal properties to wadding or fleece having a density of from about 80 to about 120 gsm. In each of the above-described embodiments of the article 40, 50, the porous aerosol containment material is free of smokable material. However, this need not always be the case.

In some embodiments, the body of porous aerosol containment material is heat resistant at least over the expected range of temperatures of the heating device 20 of the apparatus 1 that will arise in operation, such as for example 150 to 300 degrees Celsius or 170 to 220 degrees Celsius as discussed below, and will not degrade when subjected to such operation temperatures.

In some embodiments, the porous aerosol containment material helps to ensure that volatilized material generated in the article 40, 50 in use does not condense on an inner surface of the recess 13 of the apparatus 1. In some embodiments, the provision of the body of porous aerosol containment material helps to increase the surface area on which aerosol generated in the article 40, 50 in use may form. In some embodiments, such a body of porous aerosol containment material helps to increase the amount of visible aerosol generated in, or emitted from, the article 40, 50 in use, and thus may enhance the consumer experience.

In each of the above embodiments, the article 40, 50 is a consumable article. Once all, or substantially all, of the volatile component(s) of the smokable material in the article 40, 50 has/have been spent, the user may remove the article 40, 50 from the apparatus 1 and dispose of the article 40, 50. The user may subsequently mate another, unspent article 40, 50 with the interface 13 of the apparatus 1 and re-use the apparatus 1. However, in other respective embodiments, the articles 40, 50 may be non-consumable articles, and the combination of the apparatus 1 and the article 40, 50 may be disposed of together once the volatile component(s) of the smokable material in the article 40, 50 has/have been spent.

Referring to FIG. 5, there is shown a partially cut-away perspective view of an example of an apparatus 1 for heating smokable material to volatilize at least one component of the smokable material. The apparatus is particularly suitable for use with the article 40 discussed above with reference to FIGS. 1 and 2. In use, the apparatus 1 is arranged to heat the smokable material in the article 40 to volatilize at least one component of the smokable material without combusting, or burning, the smokable material. The apparatus 1 comprises a body 10 and a mouthpiece 30. The outward appearance of the apparatus 1 when assembled is defined by the combination of the body 10 and the mouthpiece 30.

The body 10 is generally tubular and elongate, has first and second opposite longitudinal ends 11, 12, and defines an interface for co-operating with the article 40. In this embodiment, the interface comprises a recess 13 for receiving the article 40. In other embodiments, the interface can take a different form, such as a shelf, a surface, or a projection, and optionally requires mechanical mating with the article 40 in order to co-operate with the article 40. The first longitudinal end 11 of the body 10 defines an opening 14 into the recess 13 at a first end of the recess 13. The opening 14 is shaped and sized so that the article 40 is movable through the opening 14 to allow a user to insert the article 40 into the recess 13 and/or to remove the article 40 from the recess 13, as will be described in more detail below. The body 10 houses electrical components of the apparatus 1. The electrical components in this embodiment comprise an electrical power source 15, a controller 16, an actuator 17, and a heating device 20.

In this embodiment, the mouthpiece 30 is generally tubular and elongate and has first and second opposite longitudinal ends 31, 32. The mouthpiece 30 comprises an inlet 34 at the second longitudinal end 32 of the mouthpiece 30, an outlet 35 at the first longitudinal end 31 of the mouthpiece 30, and a channel 36 fluidly connecting the inlet 34 with the outlet 35. The second longitudinal end 32 of the mouthpiece 30 comprises a connector (not shown) that is releasably engageable with a connector (not shown) of the first longitudinal end 11 of the body 10, so as to connect the mouthpiece 30 to the body 10. In other embodiments, the mouthpiece 30 and the body 10 may be permanently connected, such as through a hinge or flexible member. When the apparatus 1 is in use, the first longitudinal end 31 of the mouthpiece 30 forms a first longitudinal end of the apparatus 1, and the second longitudinal end 12 of the body 10 forms a second longitudinal end of the apparatus 1.

The mouthpiece 30 is locatable relative to the body 10 so as to cover the opening 14 into the recess 13. When the mouthpiece 30 is so located relative to the body 10, the first longitudinal end 31 of the mouthpiece 30 forms the first longitudinal end of the apparatus 1, and the channel 36 of the mouthpiece 30 is in fluid communication with the recess 13 via the inlet 34 of the mouthpiece 30. In some embodiments, the mouthpiece 30 includes a feature that would contact the article 40 when the article 40 is in the recess 13, to press the article 40 into the recess 13 and help ensure that the article 40 is correctly positioned relative to the heating device 20.

In this embodiment, the heating device 20 comprises a tubular heater 21 that surrounds the recess 13. The heater 21 has an annular cross-sectional shape in a plane perpendicular to an axis of the heater 21, and a radially-inner surface of the heater 21 defines the radial extent of the recess 13. The recess 13 is thus coaxial with the heater 21. The heating device 20 is attached to a retainer 18 that is fixed to the body 10 so as to retain the heater 21 in position relative to the body 10. In this embodiment, the heater 21 extends from a second end of the recess 13 to the first end of the recess 13, and an axial end of the heater 21 defines the opening 14 into the recess 13. That is, the heater 21 extends along the full axial length of the recess 13. In other embodiments, the recess 13 may be partially defined by the heater 21 and partially defined by one or more other sections of the body 10. In some embodiments, the opening 14 into the recess 13 is defined by a section of the body 10 other than the heater 21.

In this embodiment, the heater 21 comprises electrically-conductive material. In this embodiment, the electrically-conductive material is copper, but in other embodiments the electrically-conductive material may comprise any one or more of a metal, a metal alloy, steel, stainless steel, copper and nichrome. In this embodiment, the electrically-conductive material has been etched in such a manner as to be patterned to provide electrically-conductive tracks. In other embodiments, the electrically-conductive material may be printed in such a manner as to be patterned, or may be patterned by some other process. In still further embodiments, the electrically-conductive material may be non-patterned. For example, in some such embodiments, the electrically-conductive material may be a simple tubular length of the electrically-conductive material. The heater 21 is heatable by passing an electric current through the electrically-conductive material. By suitably patterning the electrically-conductive material, a cross sectional area and length of an electric current flow-path in the electrically-conductive material are set, so that heating of the heater 21 can be achieved by passing a predetermined electric current through the electrically-conductive material.

The heater 21 also comprises a support for supporting the electrically-conductive material. In this embodiment, the support is an electrical insulator and is resistant to heat. More particularly, the support is resistant to heat at least over the expected range of temperatures of the heater 21 that will arise in operation, such as for example 150 to 300 degrees Celsius or 170 to 220 degrees Celsius. In this embodiment, the support is a ceramic, but in other embodiments the support may be made from another material, such as polyimide. As discussed elsewhere herein, the controller 16 is in some embodiments arranged to ensure that the heater 21 is heated to a temperature within this range. Accordingly, the support is able to withstand the heating of the electrically-conductive material during use of the apparatus 1.

In this embodiment, the electrical power source 15 is a rechargeable battery. In other embodiments, the electrical power source 15 may be other than a rechargeable battery, such as a non-rechargeable battery or a capacitor.

In this embodiment, the controller 16 comprises an integrated circuit (IC), such as an IC on a printed circuit board (PCB). In other embodiments, the controller 16 may take a different form. The controller 16 is for controlling the supply of electrical power from the electrical power source 15 to the heating device 20. The controller 16 is operated in this embodiment by user-actuation of the actuator 17. The actuator 17 is located at the exterior of the body 10 and takes the form of a push-button. In other embodiments, a different form of actuator 17 may be provided, such as a toggle switch, a dial, or the like. Actuation of the actuator 17 by a user causes the controller 16 to cause an electric current to be applied across the electrically-conductive material of the heater 21 of the heating device 20. Such actuation of the actuator 17 may cause completion of an electrical circuit in the controller 15. As the electric current is so applied across the electrically-conductive material, the heater 21 heats up. In this embodiment, the electrical resistance of the electrically-conductive material changes as the temperature of the heater 21 increases. The controller 16 monitors the electrical resistance of the heated electrically-conductive material, and then adjusts the magnitude of the electrical current applied across the electrically-conductive material on the basis of the monitored electrical resistance as necessary, in order to ensure that the temperature of the heater remains within the above-discussed temperature range of about 150 degrees Celsius to about 300 degrees Celsius, or about 170 degrees Celsius to about 220 degrees Celsius. Within this temperature range, the smokable material in the article 40 is heated sufficiently to volatilize at least one component of the smokable material without combusting the smokable material. Accordingly, the controller 16, and the apparatus 1 as a whole, is arranged to heat the smokable material to volatilize the at least one component of the smokable material without combusting the smokable material. In other embodiments, the temperature range of heating may be other than this range.

Although not shown in the Figures, the body 10 has an inlet for admitting air into the apparatus 1 from an exterior of the apparatus 1, and the retainer 18 has a hole therethrough which places the recess 13 in fluid communication with the inlet. Therefore, when the mouthpiece 30 is connected to the body 10 to assemble the apparatus 1, there is defined an overall flow path that extends from the exterior of the apparatus 1, then through the inlet, then through the hole in the retainer 18, then through the recess 13, then through the channel 36 of the mouthpiece 30 to the exterior of the apparatus 1.

An exemplary operation of the apparatus 1 of this embodiment will now be described. A user ensures that the mouthpiece 30 is at a location relative to the body 10 at which the article 40 is movable through the opening 14. The user then passes the article 40 through the opening 14 and into the recess 13, so as to locate the article 40 within the tubular heater 21. The user then moves the mouthpiece 30 relative to the body 10 to a location at which the mouthpiece 30 covers the opening 14, with the first longitudinal end 31 of the mouthpiece 30 forming the first longitudinal end of the apparatus 1, and with the channel 36 of the mouthpiece 30 in fluid communication with the recess 13 via the inlet 34 of the mouthpiece 30. The mouthpiece 30 is retained at this location through engagement of the connector of the mouthpiece 30 with the connector of the body 10.

When the actuator 17 is subsequently actuated by the user, the controller 16 is operated to cause an electric current to be applied across the electrically-conductive material of the heater 21. This application of the electric current causes the heater 21 to heat up so as to heat the body of smokable material 43 of the article. This causes at least one component of the smokable material to volatilize without combusting the smokable material. The user draws on the outlet 35 of the mouthpiece 30. This causes a reduction in pressure in the recess 13, which causes air to be drawn into the recess 13 via the inlet of the body 10 and the hole in the retainer 18, in turn. Typically, this causes the volatilized component(s) of the smokable material 43 to be cooled, so that they condense to form an aerosol. The body of porous aerosol containment material 44 contains the aerosol generated, so as to help avoid the aerosol condensing on an inner surface of the recess 13. The user's continued drawing causes the aerosol to be drawn from the recess 13 and/or from the body of porous aerosol containment material 44 and into the user's mouth via the channel 36 of the mouthpiece 30. Each time air is drawn into the recess 13, aerosol is produced. This can be repeated until the volatile component(s) of the smokable material 43 are exhausted.

When all, or substantially all, of the volatile component(s) of the smokable material of the body of smokable material 43 has been spent, the user may move the mouthpiece 30 relative to the body 10 to a location at which the article 40 is movable through the opening 14. The user may then remove the article 40 from the recess 13 via the opening 14. The user can subsequently insert another, unspent article 40 into the recess 13 and repeat the above process.

Referring to FIG. 6, there is shown a partially cut-away perspective view of another example of an apparatus 2 for heating smokable material to volatilize at least one component of the smokable material. The apparatus 2 is particularly suitable for use with the article 50 discussed above with reference to FIGS. 3 volatilize 4. In use, the apparatus 2 is arranged to heat the smokable material in the article 50 to volatilize at least one component of the smokable material without combusting, or burning, the smokable material. The apparatus 2 of this embodiment is identical to the apparatus 1 shown in FIG. 5 and discussed above, except for the form of the heating device 20 and the controller 16. The heating device 20 of the apparatus of FIG. 6 is shown in more detail in FIG. 7.

In the apparatus 2 of FIG. 6, the heating device 20 comprises a first heater 22 extending along an axis, and a second heater 23 spaced from and at least partially surrounding the first heater 22. In this embodiment, the second heater 23 is tubular and surrounds part of the recess 13. In this embodiment, the second heater 23 has a cross-sectional shape in a plane perpendicular to the axis that is annular and circular, and a radially-inner surface of the second heater 23 defines the radial extent of the part of the recess 13. However, in other embodiments, the cross-sectional shape of the second heater 23 may be annular and other than circular, such as elliptical or polygonal, or the cross-sectional shape of the second heater 23 may be other than annular, such as an arc of a circle or semi-circular. In this embodiment, the second heater 23 is coaxial with the first heater 22, but in other embodiments this may not be true. In this embodiment, the first heater 22 projects into the recess 13 and has a circular cross-sectional shape in a plane perpendicular to the axis. However, in other embodiments, the first heater 22 may have a cross-sectional shape other than circular, such as elliptical or polygonal. The apparatus 2 of FIG. 6 is particularly suitable for use with article 50 discussed above with reference to FIGS. 3 and 4.

In this embodiment, the first heater 22 has a first length in a direction parallel to the axis, the second heater 23 has a second length in a direction parallel to the axis, and the second length is less than the first length. In this embodiment, the first and second lengths are measured from a plane that is perpendicular to the axis. In other words, in this embodiment, each of the first and second heaters 22, 23 has an axial end that lies in the plane. However, in other embodiments, each of the first and second heaters 22, 23 may have axial ends that are not coplanar with the axial ends of the other of the first and second heaters 22, 23. In this embodiment, the heating device 20 comprises a retainer 18 that is fixed to the body 10 and retains the first and second heaters 22, 23 in position relative to the body 10. The retainer 18 has a hole therethrough which places the recess 13 in fluid communication with the inlet of the body 10.

In this embodiment, the recess 13 is partially defined by the second heater 23 and partially defined by a section of the body 10. The opening 14 into the recess 13 is defined by a section of the body 10 other than the heating device 20. In this embodiment, each of the first and second heaters 22, 23 extends from a second end of the recess 13 towards the first end of the recess 13, but the second heater 23 does not extend as far as the opening 14 whereas the first heater 22 extends through the opening 14. When the assembly 1 is fully assembled, a distal end of the first heater 22, which distal end is distal from the retainer 18, is located within the mouthpiece 30. However, in some other embodiments, the second heater 23 may extend along the full axial length of the recess 13, and/or an axial end of the second heater 23 may define the opening 14 into the recess 13.

In this embodiment, each of the first and second heaters 22, 23 comprises electrically-conductive material and a support for supporting the electrically-conductive material. The electrically-conductive material and the support may be of any of the materials and forms described above for the electrically-conductive material and the support of the heater 21 of the apparatus 1 of FIG. 5, and so further detail will not be included here.

The controller 16 of the apparatus 2 of FIG. 6 is for controlling the supply of electrical power from the electrical power source 15 to the heating device 20. However, in contrast to the controller 16 of the apparatus 1 of FIG. 5, the controller 16 of the apparatus 2 of FIG. 6 is for controlling the supply of electrical power from the electrical power source 15 to the first heater 22 independently of the supply of electrical power from the electrical power source 15 to the second heater 23. Accordingly, on user-actuation of the actuator, the controller 16 may, for example, cause the controller 16 to cause a first electric current to be applied across the electrically-conductive material of one of the first and second heaters 22, 23, and then subsequently to cause a second electric current to be applied across the electrically-conductive material of the other of the first and second heaters 22, 23. The second electric current may be applied while the first electric current is applied, or after the first electric current has ceased to be applied. The manner in which the controller 16 causes electric currents to be applied across the electrically-conductive material of the first and second heaters 22, 23 may be selectable by a user, such as through the user's suitable actuation of the actuator 17 in one of a plurality of possible ways. That is, in some embodiments, the actuator 17 may be actuatable by a user in a plurality of different ways, each of which ways causes the controller 16 to cause operation of the heating device 20 in a different predetermined manner. Thus, in some embodiments, a user may be able to select which of the first and second heaters 22, 23 is to be heated, and thus which of the first and second bodies of smokable material 53, 55 is to be heated. In embodiments in which the first and second bodies of smokable material 53, 55 are heatable at different rates by a given heat source, or comprise different smoke modifying agents or flavorants, a user is thus able to select or configure the type of aerosol they wish to generate, and thus the experience they wish to have on inhaling the aerosol.

As is the case for the heating device 20 of the apparatus 1 of FIG. 5, the electrical resistance of the electrically-conductive material of the first and second heaters 22, 23 changes as the temperature of the first and second heaters 22, 23 increases. The controller 16 monitors the electrical resistance of the heated electrically-conductive material, and then adjusts the magnitude of the electrical current applied across the electrically-conductive material on the basis of the monitored electrical resistance as necessary, in order to ensure that the temperature of the heater(s) remains within the above-discussed temperature range of about 150 degrees Celsius to about 300 degrees Celsius, or about 170 degrees Celsius to about 220 degrees Celsius. Within this temperature range, the smokable material in the article 50 is heated sufficiently to volatilize at least one component of the smokable material without combusting the smokable material. Accordingly, the controller 16, and the apparatus 2 as a whole, is arranged to heat the smokable material to volatilize the at least one component of the smokable material without combusting the smokable material. In other embodiments, the temperature range of heating may be other than this range.

An exemplary operation of the apparatus 2 of this embodiment will now be described. A user slides the first heater 22 into the air gap 58 of the article 50, and passes the article 50 through the opening 14 and into the recess 13, so as to locate the article 50 within the tubular second heater 23. The user then moves the mouthpiece 30 relative to the body 10 to a location at which the mouthpiece 30 covers the opening 14, as described above for the apparatus 1 of FIG. 5.

When the actuator 17 is subsequently actuated by the user, the controller 16 is operated to cause an electric current to be applied across the electrically-conductive material of the heating device 20. This application of the electric current causes the first and/or second heater 22, 23 to heat up so as to heat the first and second bodies of smokable material 53, 55 of the article 50. When the first heater 22 is in the air gap 58 of the article 50, the first heater 22 is closer to the second body of smokable material 55 than to the first body of smokable material 53, and the second heater 23 is closer to the first body of smokable material 53 than to the second body of smokable material 55. Therefore, in use, the first heater 22 is predominantly for heating the second body of smokable material 55, and the second heater 23 is predominantly for heating the first body of smokable material 53. The heating of the first and/or second heater 22, 23 causes at least one component of the smokable material to volatilize without combusting the smokable material. The body of porous aerosol containment material 54 contains aerosol generated following volatilization of the component(s) of the smokable material, so as to help avoid the aerosol condensing on an inner surface of the recess 13 of the apparatus 2. The user inhales the aerosol by drawing on the outlet 35 of the mouthpiece 30, as described above for the apparatus 1 of FIG. 5.

When all, or substantially all, of the volatile component(s) of the smokable material of the first and/or second bodies of smokable material 53, 55 has been spent, the user may remove the article 50 from the recess 13 via the opening 14 and insert another, unspent article 50 into the recess 13 and repeat the above process.

In other embodiments, the temperature of the heater(s) 21, 22, 23 may be controlled in a different manner. For example, in some embodiments the controller 16 may monitor a current flow through the electrically-conductive material, or an output from a sensor for sensing a temperature of, or proximate, the heater(s) 21, 22, 23, and then adjust the magnitude of the electrical current applied across the electrically-conductive material on the basis of the monitored current flow as necessary, in order to ensure that the temperature of the heater remains within the above-discussed temperature range. Other ways of controlling the temperature of the heater(s) 21, 22, 23 could be used in other embodiments.

In some embodiments, any one of the apparatuses 1, 2 discussed above may be sold, supplied or otherwise provided separately from the article(s) 40, 50 with which the apparatus 1, 2 is particularly suitable for use. However, in some embodiments, one of the apparatuses 1, 2 and one or more of the articles 40, 50 may be provided together as a kit.

In order to address various issues and advance the art, the entirety of this disclosure shows by way of illustration and example various embodiments in which the claimed invention may be practiced and which provide for a superior apparatus for heating smokable material to volatilize at least one component of the smokable material and/or a superior article for use with such apparatus. The advantages and features of the disclosure are of a representative sample of embodiments only, and are not exhaustive and/or exclusive. They are presented only to assist in understanding and teach the claimed and otherwise disclosed features. It is to be understood that advantages, embodiments, examples, functions, features, structures and/or other aspects of the disclosure are not to be considered limitations on the disclosure as defined by the claims or limitations on equivalents to the claims, and that other embodiments may be utilized and modifications may be made without departing from the scope and/or spirit of the disclosure. Various embodiments may suitably comprise, consist of, or consist in essence of, various combinations of the disclosed elements, components, features, parts, steps, means, etc. The disclosure may include other inventions not presently claimed, but which may be claimed in future.

The invention claimed is:

1. An article for use with apparatus for heating smokable material to volatilize at least one component of the smokable material, the article comprising:

a body of porous aerosol containment material;

an annular first body of smokable material located around the body of porous aerosol containment material; and an annular second body of thermally-conductive material located around and in contact with the annular first body of smokable material, the annular second body of thermally-conductive material comprising a metal foil.

2. An article according to claim 1, wherein the annular first body of smokable material is in contact with the body of porous aerosol containment material.

3. An article according to claim 2, wherein the body of porous aerosol containment material is annular.

4. An article according to claim 3, wherein the body of porous aerosol containment material fills a space that is surrounded by the annular first body of smokable material.

5. An article according to claim 3, wherein the body of porous aerosol containment material is located around an air gap of the article.

6. An article according to claim 1, comprising a second body of smokable material, wherein the body of porous aerosol containment material is located around the second body of smokable material.

7. An article according to claim 6, wherein the second body of smokable material is annular.

8. An article according to claim 7, comprising an annular first body of thermally-conductive material, wherein the second body of smokable material is located around the annular first body of thermally-conductive material.

9. An article according to claim 6, wherein the smokable material of the annular first body of smokable material has a form or chemical composition that differs from the form or chemical composition, respectively, of the smokable material of the second body of smokable material.

10. An article according to claim 9, wherein the smokable material of one of the annular first body of smokable material or the second body of smokable material includes an aerosol forming agent, and the smokable material of the other of the annular first body of smokable material or the second body of smokable material is free or substantially free of the aerosol forming agent.

11. A method of manufacturing an article for use with apparatus for heating smokable material to volatilize at least one component of the smokable material, the method comprising:

providing an assembly comprising porous aerosol containment material on a first layer of smokable material, and a second layer of thermally-conductive material comprising a metal foil, the first layer of smokable material being on the second layer of thermally-conductive material; and rolling the assembly so that the first layer of smokable material becomes an annular first body of smokable material located around the porous aerosol containment material and so that the second layer of thermally-conductive material becomes an annular second body of thermally-conductive material located around and in contact with the annular first body of smokable material.

12. A method according to claim 11, wherein the rolling comprises rolling the assembly so that the porous aerosol containment material becomes an annular body of porous aerosol containment material which is arranged to be located around an air gap of the article.

13. A method according to claim 11, wherein the assembly comprises a second layer of smokable material on the porous aerosol containment material.

14. A method according to claim 13, wherein the smokable material of the first layer of smokable material has a form or chemical composition that differs from the form or chemical composition, respectively, of the smokable material of the second layer of smokable material.

15. A kit comprising:

an article for use with apparatus for heating smokable material to volatilize at least one component of the smokable material, the article comprising a body of porous aerosol containment material, an annular first body of smokable material located around the body of porous aerosol containment material, and an annular second body of thermally-conductive material located around and in contact with the annular first body of smokable material, the annular second body of thermally-conductive material comprising a metal foil; and apparatus for heating the smokable material of the article to volatilize at least one component of the smokable material, wherein the apparatus has an interface and the article is for co-operating with the interface of the apparatus.

16. An article according to claim 8, wherein the annular first body of thermally-conductive material comprises a metal foil.

* * * * *